US005613834A

United States Patent [19]

Du

[11] Patent Number: 5,613,834

[45] Date of Patent: Mar. 25, 1997

[54] POSITIVE DISPLACEMENT PUMP INCLUDING MODULAR PUMP COMPONENT

[76] Inventor: Benjamin R. Du, 22832 Skyview Ave., Laguna Beach, Calif. 92677

[21] Appl. No.: 648,317

[22] Filed: May 15, 1996

Related U.S. Application Data

[63] Continuation of Ser. No. 252,274, Jun. 1, 1994, Pat. No. 5,540,556.

[51] Int. Cl.[6] ..... F04B 49/00

[52] U.S. Cl. ..... 417/44.8; 417/238; 417/270

[58] Field of Search ..... 417/44.8, 238, 417/270

[56] References Cited

U.S. PATENT DOCUMENTS

| | | | |
|---|---|---|---|
| 2,501,054 | 3/1950 | Huber | 417/270 X |
| 3,202,105 | 8/1965 | Badenoch et al. | 417/270 X |
| 3,694,105 | 9/1972 | Martin | 417/44.8 |
| 3,953,154 | 4/1976 | Wanner | 417/270 |
| 4,474,542 | 10/1984 | Kato et al. | 417/270 |
| 4,576,554 | 3/1986 | Wagenser et al. | 417/270 |
| 5,285,641 | 2/1994 | Goto et al. | 417/270 |
| 5,318,410 | 6/1994 | Kawamura et al. | 417/270 X |
| 5,332,365 | 7/1994 | Taguchi | 417/270 X |
| 5,352,096 | 10/1994 | Chin-Wen | 417/448 |

*Primary Examiner*—Richard E. Gluck
*Attorney, Agent, or Firm*—Stetina Brunda & Buyan

[57] ABSTRACT

A positive displacement pump comprising a housing which defines a pump inlet chamber in fluid communication with a pump inlet port and a pump outlet chamber in fluid communication with a pump outlet port. Disposed within the housing is a wobble plate which is adapted to pump fluid from the inlet chamber to the outlet chamber. Selectively insertable into and removable from within the housing is a modular pump component. The modular pump component is adapted to modify the operational characteristics of the pump when inserted into the pump housing.

20 Claims, 3 Drawing Sheets

Fig. 5
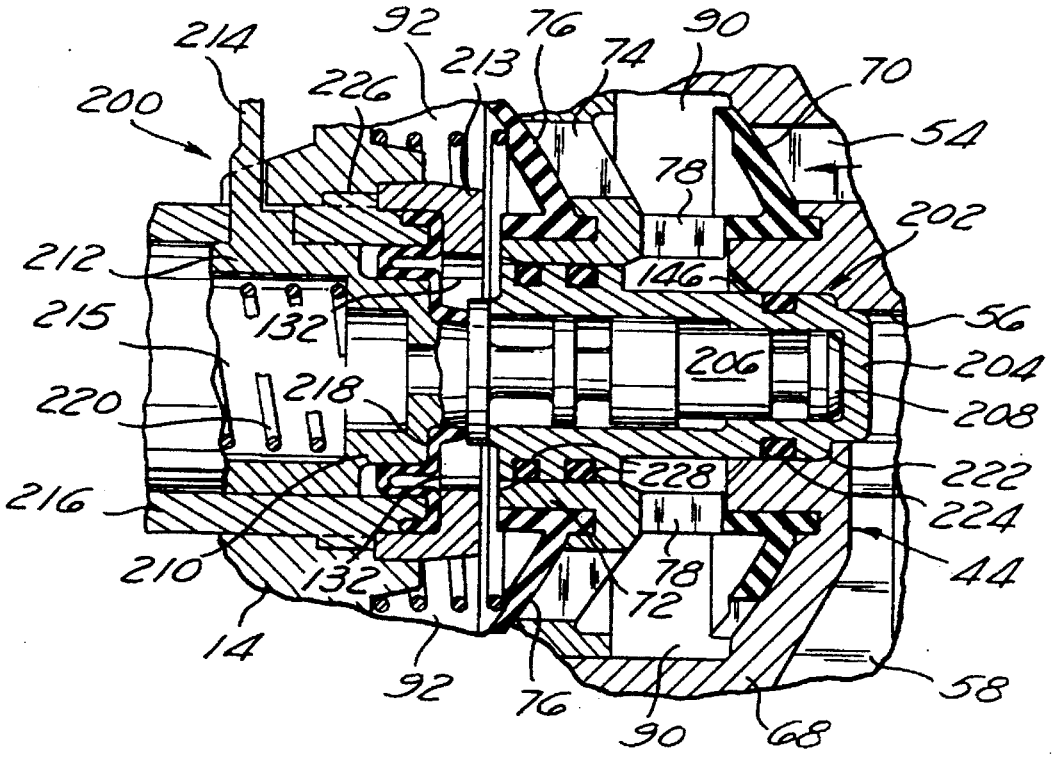
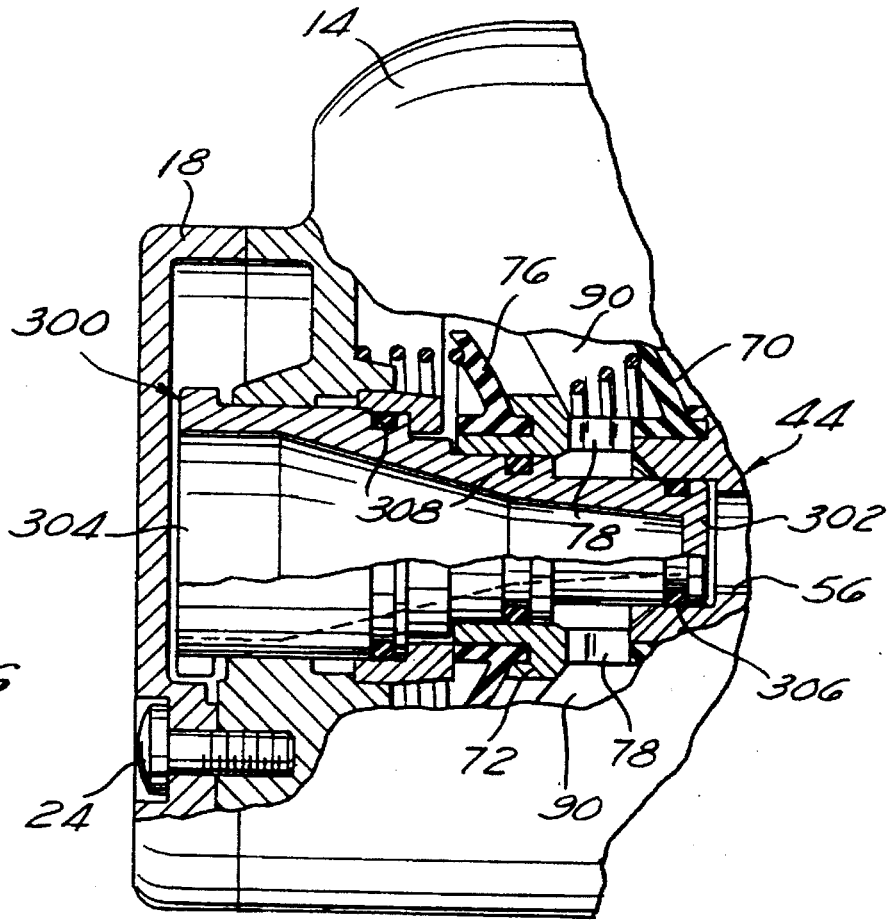
Fig. 6

POSITIVE DISPLACEMENT PUMP INCLUDING MODULAR PUMP COMPONENT

This application is a continuation of application Ser. No. 08/252,274, filed Jun. 1, 1994, now U.S. Pat. No. 5,540,556.

FIELD OF THE INVENTION

The present invention relates generally to pumps, and more particularly to a positive displacement pump which incorporates a modular pump component selectively insertable into and removable from within the pump housing, and adapted to modify the operational characteristics of the pump when inserted into the housing.

BACKGROUND OF THE INVENTION

There exists in the prior art a multitude of positive displacement pumps, each of which are adapted to receive fluid from an inlet line and discharge the fluid into an outlet line at an increased pressure level. In most prior art positive displacement pumps, a blockage in the outlet line creates an excessive pressure build-up within the pump housing which typically causes the pump motor to overheat and eventually fail. Small pumps incorporating small, light duty motors are particularly prone to such overheating and failure during occurrences of outlet line blockage.

To aid in the prevention of pump motor overheating and failure, it has become a common practice in the prior art to insert a pressure relief valve into the outlet line of the pump to prevent the fluid pressure within the pump housing from exceeding a predetermined maximum level. However, this prior art method of providing pressure relief subjects the pump to a maximum change in pressure at the highest work output of the pump motor (which is non-productive due to the outlet line blockage), thus putting considerable strain on the motor and leading to accelerated wear and failure.

In addition to the foregoing, the prior art positive displacement pumps are generally configured to function in only a single operational mode. In this respect, the modification of the operational characteristics of the pump generally requires the performance of retrofit procedures which are both time consuming and expensive. In view of the difficulties associated with such pump modifications, a required change in the operational characteristics of the pump typically necessitates the replacement of the entire pump rather than attemptzing to modify the same.

The positive displacement pump constructed in accordance with the present invention is intended to overcome the deficiencies associated with similar prior art pumps. In particular, the present pump incorporates a modular pump component which is selectively insertable into and removable from within the pump housing and adapted to modify the operational characteristics of the pump when inserted into the housing. The modular pump component may comprise an unloader valve which reduces the change in pressure within the housing to zero in the event of an outlet line blockage and allows the pump motor to go into a free run condition thus prolonging its useful life. Alternatively, the modular pump component may comprise a motor speed control valve which is adapted to decrease the rotational speed of the motor proportionally to increases in the fluid pressure in the housing, and increase the rotational speed of the motor proportionally to decreases in the fluid pressure in the housing.

SUMMARY OF THE INVENTION

In accordance with a preferred embodiment of the present invention, there is provided a positive displacement pump comprising a housing which itself defines an inlet chamber in fluid communication with an inlet port and an outlet chamber in fluid communication with an outlet port. Disposed within the housing is a wobble plate which is adapted to pump fluid from the inlet chamber to the outlet chamber. The outlet chamber of the pump preferably includes a plurality of wedge-shaped chamber sections which are successively filled with and purged of fluid during the gyration of the wobble plate. Additionally, attached to the housing is a pump motor having a rotatable drive shaft extending therefrom to which the wobble plate is attached. The pump further comprises a modular pump component which is selectively insertable into and removable from within the housing, and adapted to modify the operational characteristics of the pump when inserted into the housing.

In accordance with a first embodiment of the present invention, the modular pump component may comprise an unloader valve which is adapted to facilitate the flow of fluid from the outlet chamber to the inlet chamber when the fluid pressure in the outlet chamber exceeds a first predetermined level, thus causing the fluid to be recirculated within the housing. The unloader valve preferably comprises a piston which is reciprocably movable within the housing between a first position whereat the piston blocks a fluid passage extending from the outlet chamber to the inlet chamber, and a second position whereat the piston allows the fluid to flow from the outlet chamber to the inlet chamber via the fluid passage. The unloader valve further comprises a biasing spring for biasing the piston to the first position. In the pump incorporating the unloader valve, an increase in the fluid pressure in the outlet chamber above the first predetermined level is operable to overcome the biasing force exerted by the biasing spring and move the piston from the first position to the second position.

The unloader valve piston itself preferably comprises an elongate stem which defines first and second opposed end portions. Attached to the first end portion of the stem is a lower sleeve which is adapted to block the fluid passage when the piston is in the first position, and allow fluid to flow from the outlet chamber to the inlet chamber via the fluid passage when the piston is in the second position. The lower sleeve defines first and second ends and a central bore adapted to receive the first end portion of the stem. Formed about the first end is a first radially extending flange portion which includes at least one notch disposed therein, while formed about the second end is a second radially extending flange portion also including at least one notch disposed therein which is preferably smaller than the notch disposed in the first flange portion. Additionally, formed between the first and second flange portions is a central radially extending flange portion. In the unloader valve, the lower sleeve is attached to the stem such that the first flange portion is disposed furthest from the second end portion of the stem. However, the lower sleeve is alternatively attachable to the stem in an inverted orientation such that the second flange portion is disposed furthest from the second end portion of the stem.

The unloader valve further comprises a limit switch which is adapted to be tripped by the piston when the fluid pressure in the outlet chamber exceeds a second predetermined level. When tripped by the piston, the limit switch is operable to deactivate the pump motor. In this respect, the piston further comprises an upper sleeve which is attached to the second end portion of the stem and configured to trip the limit switch when the fluid pressure in the outlet chamber exceeds the second predetermined level.

In accordance with a second embodiment of the present invention, the modular pump component may comprise a motor speed control valve which is adapted to decrease the rotational speed of the pump motor proportionally to increases in the fluid pressure in the outlet chamber, and increase the rotational speed of the pump motor proportionally to decreases in the fluid pressure in the outlet chamber. The motor speed control valve preferably comprises a tubular valve plug which defines a closed distal end and is adapted to block the fluid passage extending from the outlet chamber to the inlet chamber. Disposed within the valve plug is a piston which is reciprocably movable therewithin away from and toward a base position whereat the piston is abutted against the closed distal end of the valve plug.

The motor speed control valve further comprises a biasing spring for biasing the piston to the base position, and a speed control unit which is cooperatively engaged to the piston in a manner wherein the movement of the piston away from the base position decreases the rotational speed of the motor and the movement of the piston toward the base position increases the rotational speed of the motor. In this respect, the rotational speed of the motor is maximized when the piston is disposed at the base position. In the pump incorporating the motor speed control valve, an increase in the fluid pressure in the outlet chamber beyond the first predetermined level is operable to overcome the biasing force exerted by the biasing spring and move the piston away from the base position. Conversely, a decrease in the fluid pressure in the outlet chamber below the first predetermined level is operable to move the piston toward and subsequently into the base position. The piston of the motor speed control valve itself preferably comprises elongate stem having an upper sleeve attached thereto which is cooperatively engaged to the speed control unit.

In accordance with a third embodiment of the present invention, the modular pump component may comprise a valve plug which is adapted to block the fluid passage extending from the outlet chamber to the inlet chamber when inserted into the pump housing.

Due to the inclusion of the modular pump component, the operational characteristics of the positive displacement pump constructed in accordance with the present invention may be easily, quickly and inexpensively modified as desired. In particular, the pump may be provided with the unloader valve which eliminates the need for a down-line pressure relief valve, and prolongs the life of the pump by allowing the pump motor to go to a free-run condition when the fluid pressure within the pump housing exceeds a predetermined level. Providing the pump with the motor speed control valve also eliminates the need for a down-line pressure relief valve since the rotational speed of the pump motor is increased and decreased proportionately to increases and decreases in the fluid pressure in the pump housing. Finally, if a down-line pressure relief valve is already in place, the pump may be provided with the valve plug. Advantageously, the unloader valve and motor speed control valve are each attached to the housing via a bayonet connection, thus adding to the speed and simplicity by which the operational characteristics of the pump may be modified. When it is desired to modify the operational characteristics of the pump, the modular pump component need simply be "changed out" with an alternative pump component, rather than the entire pump having to be replaced with a differently functioning pump.

BRIEF DESCRIPTION OF THE DRAWINGS

These, as well as other features of the present invention will become more apparent upon reference to the drawings wherein:

FIG. 5 is a partial cross-sectional view of the pump of the present invention including a modular motor speed control valve inserted into the pump housing; and FIG. 6 is a partial cross-sectional view of the pump of the present invention including a modular valve plug inserted into the pump housing.

DETAILED DESCRIPTION OF THE PREFERRED EMBODIMENTS

Figure 1:
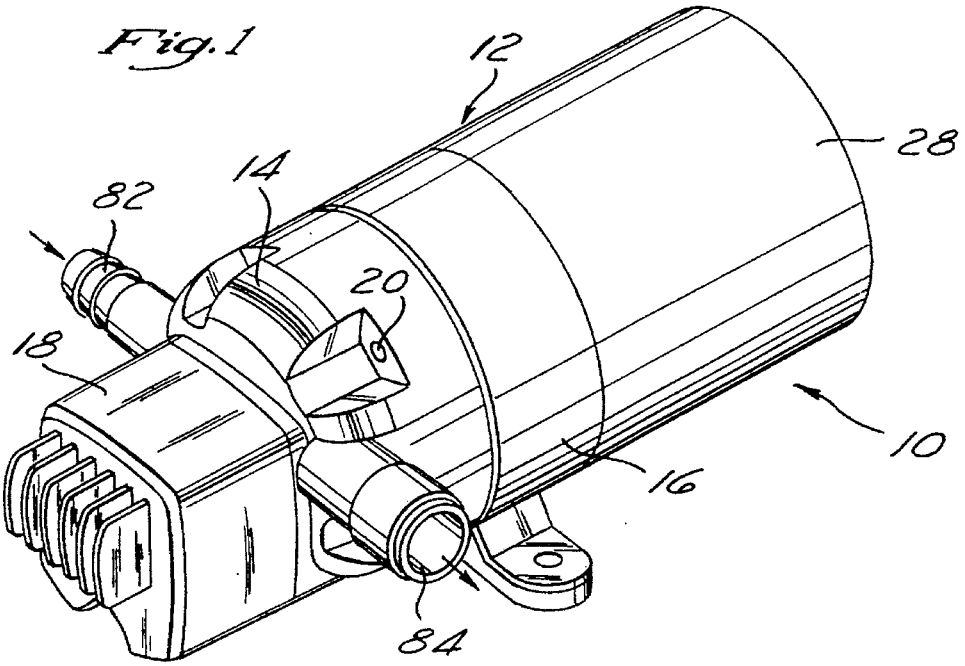
FIG. 1 is a perspective view of a positive displacement pump constructed in accordance with the present invention.

Referring now to the drawings wherein the showings are for purposes of illustrating preferred embodiments of the present invention only, and not for purposes of limiting the same, FIG. 1 perspectively illustrates a positive displacement pump 10 constructed in accordance with the present invention. In the preferred embodiment, the pump 10 is configured to have any one of three differently configured modular pump components inserted thereinto. However, prior to discussing the structure and functionality of each of the individual modular pump components, the common parts of the pump 10 to which the modular pump components are each interfaced will initially be described.

Figure 2:
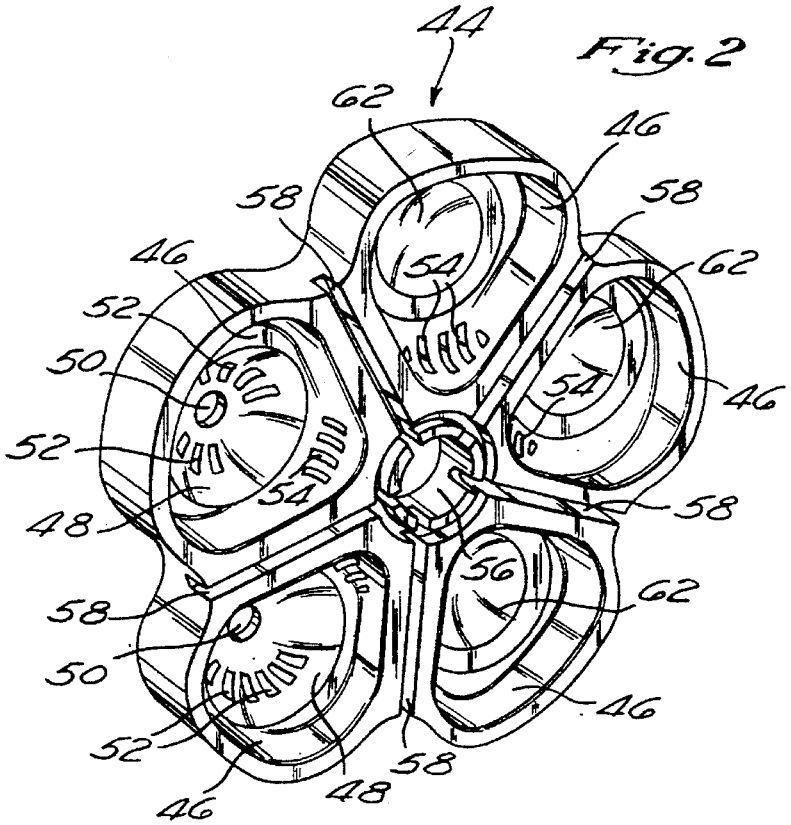
FIG. 2 is a perspective view of an internal chamber plate of the pump which defines a plurality of wedge-shaped chamber sections of the outlet chamber of the pump and a fluid passage between the inlet and outlet chambers of the pump.
Figures 3, 4:
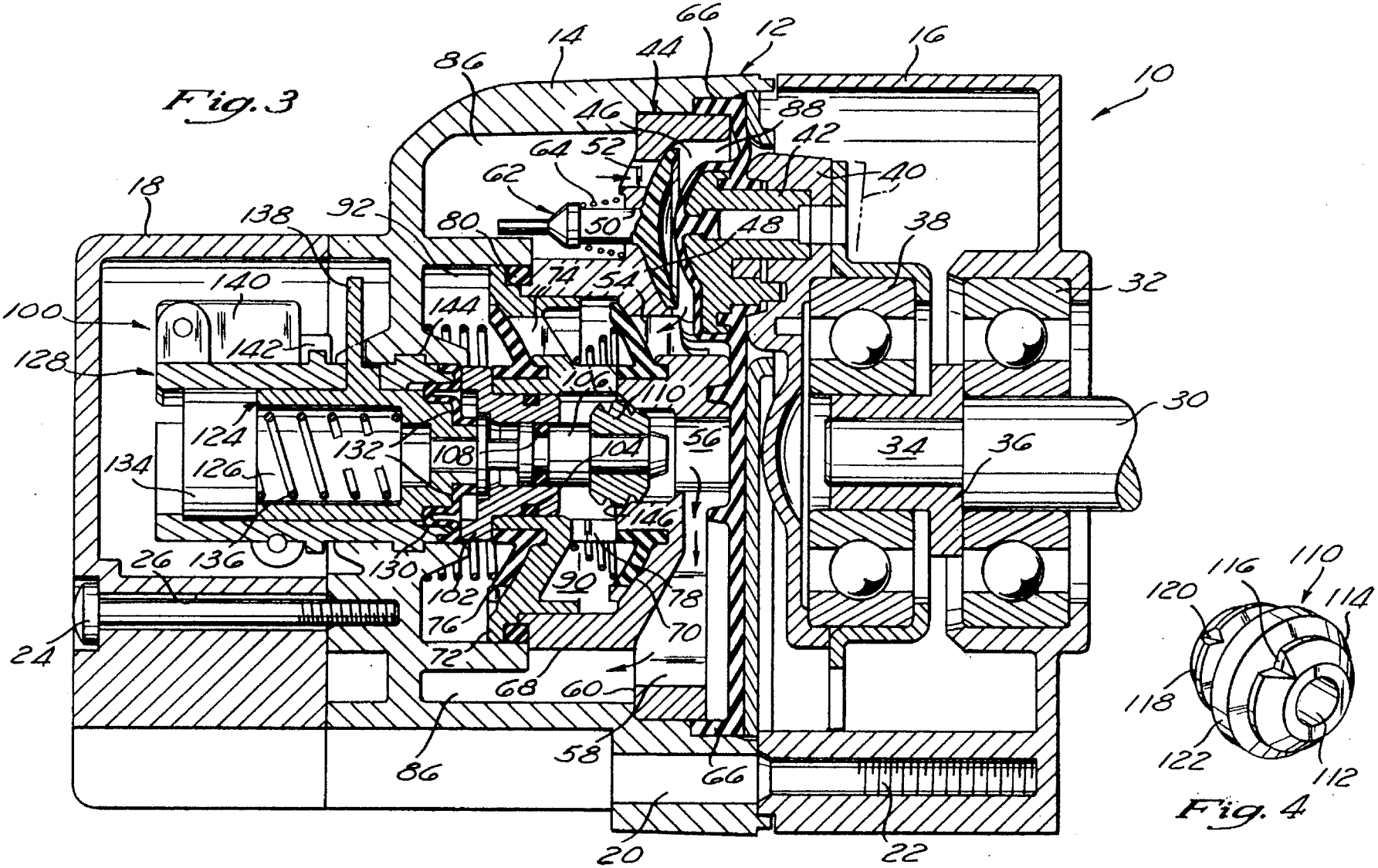
FIG. 3 is a cross-sectional view of the pump of the present invention including a modular unloader valve inserted into the pump housing.
FIG. 4 is a perspective view of the lower sleeve of the unloader valve.

Referring now to FIGS. 1–3, the pump 10 generally comprises a pump housing 12 which itself comprises a first housing section 14 having a second housing section 16 attached to one end thereof and an end cap 18 attached to the other end thereof. The attachment of the second housing section 16 to the first housing section 14 is accomplished by the extension of fasteners such as bolts through apertures 20 defined within the peripheral regions of the first housing section 14 and into corresponding internally threaded apertures 22 which are defined within the second housing section 16 and coaxially aligned with the apertures 20. The attachment of the end cap 18 to the first housing section 14 is facilitated by the extension of a fastener such as a bolt 24 through an aperture 26 extending through the end cap 18 and into a corresponding internally threaded aperture which is disposed within the first housing section 14 and coaxially aligned with the aperture 26.

Attached to the second housing section 16 is a pump motor 28 having a rotatable drive shaft 30 extending axially therefrom. As best seed in FIG. 1, the first and second housing sections 14, 16 and pump motor 28 each have generally cylindrical configurations of substantially equal diameter, thus defining a continuous outer surface when attached to each other. The drive shaft 30 of the motor 28 extends into the second housing section 16 and through a first bearing 32 mounted therewithin. Attached to the reduced diameter distal end 34 of the drive shaft 30 is a tubular sleeve 36 which includes a second bearing 38 mounted thereon. Attached to the second bearing 38 is a wobble plate 40. Though not shown, the outer surface of the sleeve 36 is oblique to the axis of the drive shaft 30. Due to the mounting of the second bearing 38 upon the outer surface of the sleeve 36 and attachment of the wobble plate 40 to the second bearing 38, the rotation of the drive shaft 30 resulting from the activation of the motor 28 causes the wobble plate 40 to gyrate (as shown in phantom in FIG. 3).

The wobble plate 40 itself defines five (5) separate recessed regions which are spaced equidistantly about the periphery thereof. Disposed within each of the recessed regions of the wobble plate 40 is a purge member 42. Though only one recessed region and associated purge member 42 is shown in FIG. 3, it will be recognized that the wobble plate 40 includes the five (5) recessed regions as previously described, each of which includes a purge member 42 disposed therein. Both the second bearing 38 and wobble plate 40 attached thereto reside within the second housing section 16. Though the ends of the purge members 42 disposed within the recessed regions of the wobble plate 40 also reside within the second housing section 16, the opposite arcuately shaped ends of the purge members 42 reside within the first housing section 14.

Referring now to FIGS. 2 and 3, disposed in the first housing section 14 in close proximity to the wobble plate 40 is a chamber plate 44. In the pump 10, the chamber plate 44 defines five (5) identically configured pie or wedge-shaped chamber sections 46 spaced equidistantly about the periphery thereof. Each chamber section 46 itself defines a dome-shaped recessed portion 48 having an aperture 50 disposed centrally therewithin. Also disposed within the recessed portion 48 about the aperture 50 are a plurality of inlet ports 52. In addition to the inlet ports 52, each chamber section 46 includes a plurality of outlet ports 54 disposed in the apex thereof. The chamber plate 44 further defines a circularly configured fluid passage 56 extending through the center thereof. Communicating with and extending radially from the fluid passage 56 are five (5) flow channels 58, each of which extends between a respective pair of the chamber sections 46 to the inner surface 60 of the chamber plate 44.

Disposed within each of the chamber sections 46 of the chamber plate 44 is a unidirectional umbrella valve 62. In the pump 10, the elongate, generally cylindrical base portion of each umbrella valve 62 is extended through the aperture 50 of a respective recessed portion 48 such that the arcuately shaped head portion thereof is disposed flush against the dome-shaped surface of the recessed portion 48. Due to the formation of the inlet ports 52 in close proximity to the aperture 50, the head portion of the umbrella valve 62 blocks (i.e., seals) each of the inlet ports 52 when abutted against the dome-shaped surface of the recessed portion 48. As seen in FIG. 3, the head portion of each umbrella valve 62 is normally biased against the dome-shaped surface of a respective recessed portion 48 by a biasing spring 64 extending between the inner surface 60 of the chamber plate 44 and an enlarged distal region of the base portion of the umbrella valve 62.

The chamber plate 44 is mounted within the first housing section 14 in a manner wherein the chamber sections 46 are directed toward (i.e., face) the purge members 42. Importantly, the wobble plate 40 and hence the purge members 42 are oriented relative the chamber plate 44 such that the arcuately shaped ends of each of the purge members 42 are received into respective ones of the chamber sections 46. Attached to the central portion of the chamber plate 44 is a diaphragm 66 which forms a fluid barrier between the first and second housing sections 14, 16 and seals one end of the fluid passage 56. The peripheral region of the diaphragm 66 is formed so as to be extensible over and attachable to the arcuately shaped ends of each of the purge members 42. In addition to the diaphragm 66 being attached to both the chamber plate 44 and purge members 42, portions thereof are captured between the purge members 42 and the wobble plate 40 and between the chamber plate 44 and first housing section 14.

Formed on the inner surface 60 of the chamber plate 44 is an annular flange portion 68 which circumvents the fluid passage 56. Disposed within the flange portion 68 and attached to the inner surface 60 is a first unidirectional valve 70 which has an annular configuration and extends about the fluid passage 56. When attached to the chamber plate 44, the first unidirectional valve 70 blocks the outlet ports 54 which extend from the chamber sections 46 to the inner surface 60. Attached to the distal rim of and partially disposed within the flange portion 68 is a spacer member 72 which defines a central opening and a plurality of fluid ports 74 disposed in the peripheral regions thereof. Attached to the spacer member 72 is a second unidirectional valve 76 which is configured identically to the first unidirectional valve 70 and extends about the central opening of the spacer member 72 while blocking the fluid ports 74 disposed therein. In addition to the fluid ports 74, the spacer member 72 includes a plurality of fluid ports 78 disposed within the sidewall portion thereof which defines the central opening. When the spacer member 72 is properly inserted into the flange portion 68 of the chamber plate 44, a circumferential groove is defined between the spacer member 72 and chamber plate 44 into which is disposed an O-ring 80. The O-ring 80 forms a fluid-tight seal between the chamber plate 44 and spacer member 72, and an inner wall of the first housing section 14.

Referring now to FIGS. 1 and 3, the first housing section 14 defines a fluid inlet port 82 and a fluid outlet port 84. The fluid inlet port 82 communicates with an inlet chamber 86 which is defined within the first housing section 14. In particular, the inlet chamber 86 of the pump 10 is generally defined by the inner surface 60 and flange portion 68 of the chamber plate 44, and the inner surface of the first housing section 14. As such, the elongate base portion of each of the umbrella valves 62 extends into the inlet chamber 86 of the pump 10. In addition to the inlet chamber 86, the first housing section 14 defines an outlet chamber which itself comprises a series of outlet chamber regions. In particular, the outlet chamber comprises five (5) first outlet regions 88, each of which is defined within a respective chamber section 46 of the chamber plate 44 between the head portion of the umbrella valve 62 and the arcuately shaped, diaphragm covered end of the purge member 42. In addition to the first outlet regions 88, the outlet chamber includes a second outlet region 90 which is defined by the flange portion 68 of the chamber plate 44, spacer member 72 and first unidirectional valve 70. The outlet chamber further includes a third outlet region 92 which is defined by the spacer member 72, second unidirectional valve 76 and inner surface of the first housing section 14. The fluid outlet port 84 of the pump 10 communicates directly with the third outlet region 92.

In the pump 10, the activation of the pump motor 28 facilitates the rotation of the drive shaft 30. Due to the configuration of the sleeve 36, the rotation of the drive shaft 30 causes the wobble plate 40, and hence the purge members 42, to gyrate, with the purge members 42 moving toward and away from the umbrella valves 62 in succession. The movement of each purge member 42 away from a respective umbrella valve 62 creates a vacuum within the first outlet region 88 which is sufficient to overcome the biasing force exerted on the umbrella valve 62 by the biasing spring 64, and pull the head portion thereof away from the dome-shaped surface of the recessed portion 48. Importantly, this movement of the umbrella valve 62 which is facilitated by the compression of the biasing spring 74 unblocks the inlet ports 52 of the chamber plate 44, thus allowing fluid to flow from the inlet chamber 86 into the first outlet region 88 via the inlet ports 52. The subsequent movement of the purge member 42 toward the umbrella valve 62 forces the head portion thereof back into contact with the dome-shaped surface of the recessed portion 48, thus blocking the inlet ports 52. At the same time, the first outlet region 88 is essentially collapsed, thus forcing the fluid through the outlet ports 54 of the chamber plate 44 and through the first unidirectional valve 70 into the second outlet region 90. Importantly, the fluid pressure is sufficient to additionally force the fluid through the fluid ports 74 of the spacer member 72 and through the second unidirectional valve 76 into the third outlet region 92. The fluid flows from the third outlet region 92 into the fluid outlet port 84. As will be recognized, the backflow of fluid from the first outlet regions 88 into the inlet chamber 86 is prevented by the umbrella valves 62, with the backflow of fluid from the second outlet region 90 into the first outlet regions 88 being prevented by the first unidirectional valve 70. Further, the backflow of fluid from the third outlet region 92 into the second outlet region 90 is prevented by the second unidirectional valve 76.

As previously explained, the pump 10 of the present invention is provided with any one of three (3) modular pump components which are selectively insertable into and removable from within the pump housing 12 and adapted to modify the operational characteristics of the pump 10 when inserted into the housing 12. Having thus described the common components of the pump 10, the structure and function of each of the three individual modular pump components will now be described.

UNLOADER VALVE STRUCTURE AND OPERATION

Referring now to FIGS. 3 and 4, a first modular pump component which may be included in the pump 10 is an unloader valve 100. As will hereinafter be described, the unloader valve 100 is adapted to facilitate the flow of fluid from the second outlet region 90 to the inlet chamber 86 when the fluid pressure in the third outlet region 92 exceeds a predetermined level, thus causing the fluid to be recirculated within the first housing section 14 of the pump 10. The unloader valve 100 preferably comprises a generally cylindrical support member 102 which defines a central bore and is partially inserted into the central opening of the spacer member 72. Disposed within a circumferential groove formed in the outer surface of the support member 102 is an O-ring 104 which forms a fluid-tight seal between the support member 102 and the spacer member 72. Inserted into the central bore of the support member 102 is an elongate stem 106 defining a first end portion which extends through the central opening of the spacer member 72 and partially into the fluid passage 56 of the chamber plate 44. Disposed within a circumferential groove formed within the central portion of the stem 106 is an O-ring 108 which forms a fluid-tight seal between the stem 106 and the inner surface of the support member 102 defining the central bore thereof.

Attached to the first end portion of the stem 106 is a lower sleeve 110. As best seen in FIG. 4, the lower sleeve 110 defines a central aperture 112 which is sized and configured to receive the first end portion of the stem 106. Formed about one end of the central aperture 112 is a first radially extending flange portion 114 which has a triangular cross-sectional configuration and includes at least one wedge-shaped notch 116 disposed therein. Formed about the opposite end of the central aperture 112 is a second radially extending flange portion 118 which also has a triangular cross-sectional configuration and includes at least one wedge-shaped notch 120 disposed therein. Importantly, the notch 120 formed in the second flange portion 118 is of a smaller size than a notch 116 formed in the first flange portion 114 for reasons which will be discussed below. Formed between the first and second flange portions 114, 118 is a central radially extending flange portion 122 which has a generally square cross-sectional configuration. The lower sleeve 110 is preferably fabricated from rubber, though other materials may also be utilized.

Attached to the second end portion of the stem 106 (which is opposite the first end portion) is an upper sleeve 124 which defines a cylindrically configured interior chamber 126. The upper sleeve 124 is slidably positioned within a tubular outer jacket 128. Disposed between the outer jacket 128, upper sleeve 124 and support member 102 is a flexible diaphragm 130, the peripheral edge of which is compressed between the outer jacket 128 and support member 102. When the unloader valve 100 is inserted into the housing 12, a fourth outlet region 132 of the outlet chamber which is in fluid communication with the third outlet region 92 is defined by the diaphragm 130 and support member 102. In this respect, fluid flowing into the third outlet region 92 also flows into the fourth outlet region 132.

The outer jacket 128 of the unloader valve 100 itself defines a cup-shaped end portion 134. Disposed within the end portion 134 and extending axially through the interior chamber 126 of the upper sleeve 124 into abutting contact with the innermost surface thereof is a biasing spring 136. The biasing spring 136 biases the upper sleeve 124, stem 106 and lower sleeve 110 toward the chamber plate 44. The upper sleeve 124 further defines a laterally extending flag portion 138 which passes through and is slidable within an elongate slot extending longitudinally in the side wall of the outer jacket 128. Attached to the outer surface of the outer jacket 128 is a limit switch 140 including an actuation arm 142 which is adapted to be tripped by the flag portion 138 of the upper sleeve 124 as will hereinafter be described.

The unloader valve 100 is inserted into the pump housing 12 by initially removing the end cap 18 from the first housing section 14 and inserting the first end portion of the stem 106 (including the lower sleeve 110 attached thereto) into the central opening of the spacer member 72. Thereafter, the support member 102 (through which the stem 106 is extended) is inserted into the central opening of the spacer member 72 thus causing the first end portion of the stem 106 and the lower sleeve 110 to be partially disposed within the fluid passage 56 of the chamber plate 44. The outer jacket 128 is then rotated so as to cause a pair of flange portions 144 formed on the outer surface thereof to properly seat within corresponding recesses formed within the first housing section 14. In this respect, the flange portions 144 in combination with the recesses formed within the first housing section 14 define a bayonet-type connection Which allows the unloader valve 100 to be rapidly insertable into and removable from within the housing 12. As previously indicated, once the unloader valve 100 is inserted into and connected to the first housing section 14, the fourth outlet region 132 is defined between the diaphragm 130 and support member 102. It will be understood that the components comprising the unloader valve 100 are pre-assembled into a modular pump component prior to being inserted into the housing 12 in the aforementioned manner. Once the unloader valve 100 has been properly inserted into the first housing section 14 and locked therein by the previously described bayonet connection, the end cap 18 is re-attached to the first housing section 14 via the bolt 24.

When the unloader valve 100 is initially inserted into and connected to the first housing section 14, the biasing spring 136 biases the lower sleeve 110 (which is attached to the first end portion of the stem 106) against an annular, beveled valve seat 146 defined by the chamber plate 44 and formed about one end of the fluid passage 56 extending therethrough. The lower sleeve 110 is normally attached to the first end portion of the stem 106 such that the first flange portion 114 thereof is disposed furthest from the upper sleeve 124. When the lower sleeve 110 is biased against the valve seat 146, the central flange portion 122 is disposed in sealed engagement to the beveled surface of the valve seat 146, with the first flange portion 114 residing within the fluid passage 56. Additionally, a relatively narrow gap is defined between the flag portion 138 of the upper sleeve 124 and the actuation arm 142 of the limit switch 140.

With the unloader valve 100 inserted into the housing 12, the activation of the pump motor 28 causes fluid introduced into the inlet chamber 86 via the fluid inlet port 82 to be drawn into the first outlet regions 88 via the inlet ports 52 as previously described, and subsequently forced through the outlet ports 54 and first unidirectional valve 70 into the second outlet region 90, and through the fluid port 74 and second unidirectional valve 76 into the third outlet region 92 and fourth outlet region 132. The diaphragm 130 prevents any fluid from flowing from the fourth outlet region 132 between the outer jacket 128 and first housing section 14, or between the outer jacket 128 and upper sleeve 124. Due to the inclusion of the fluid ports 78 within the spacer member 72, fluid entering the second outlet region 90 also flows into the central opening of the spacer member 72 between the lower sleeve 110 and support member 102. However, such fluid is prevented from #1owing into the fluid passage 56 by the sealed engagement of the central flange portion 122 against the valve seat 146, and prevented from flowing between the stem 106 and support member 102 by the O-ring 108. The fluid is also prevented from flowing between the support member 102 and spacer member 72 by the O-ring 104.

During normal operation of the pump 10, the fluid flows from the third and fourth outlet regions 92, 132 into the fluid outlet port 84. As will be recognized, if the flow of fluid through the fluid outlet port 84 is stopped by a down-line blockage, the fluid pressure within the third and fourth outlet regions 92, 132 will begin to increase. Importantly, such fluid pressure will be exerted on the diaphragm 130 in a direction toward the end cap 18. When the fluid pressure against the diaphragm 130 exceeds the biasing force exerted by the biasing spring 136, the upper sleeve 124, and hence the stem 106 and lower sleeve 110, will begin to move axially toward the end cap 18. When such axial movement occurs, the central flange portion 122 of the lower sleeve 110 moves out of sealed contact with the valve seat 146, thus allowing the fluid within the second outlet region 90 to flow through the fluid ports 78 and through the notch 116 disposed within the first flange portion 114 into the fluid passage 56 of the chamber plate 44. Since the peripheral edge of the first flange portion 114 is typically still in contact with the inner surface of the fluid passage 56, the fluid flows almost exclusively through the notch 116 into the fluid passage 56. After flowing through the fluid passage 56, the fluid flows radially outward through the flow channels 58 of the chamber plate 44 and subsequently back into the inlet chamber 86 via the flow channel openings disposed in the inner surface 60 of the chamber plate 44. As such, the axial movement of the stem 106 and lower sleeve 110 toward the end cap 18 brought on by the increased fluid pressure within the third and fourth outlet regions 92, 132 causes the fluid to be recirculated within the first housing section 14, thus allowing the pump motor 28 to go to a free run condition which prolongs its life as well as that of the pump 10.

If the down-line blockage remains for an extended period of time, the fluid pressure within the third and fourth outlet regions 92, 132 will continue to increase, despite the recirculation of the fluid within the first housing section 14 in the previously described manner. Such increasing fluid pressure facilitates the continued axial movement of the upper sleeve 124, stem 106 and lower sleeve 110 toward the end cap 18. As the upper sleeve 124 slides axially within the outer jacket 128 toward the end cap 18, the flag portion 138 thereof will eventually move through the slot within the outer jacket 128 into contact with the actuation arm 142 of the limit switch 140. Importantly, the contact between the flag portion 138 and the actuation arm 142 serves to "trip" the limit switch 140. The tripping of the limit switch 140 (which is electrically connected to the pump motor 28) deactivates the pump motor 28, thus preventing any additional fluid pressure build-up within the third and fourth outlet regions 92, 132.

When the down-line blockage is removed, the resultant reduction in fluid pressure in the third and fourth outlet regions 92, 132 allows the biasing spring 136 to move the upper sleeve 124, stem 106 and lower sleeve 110 axially toward the chamber plate 44. When the flag portion 138 moves out of contact with the actuation arm 142 of the limit switch 140, the operation of the pump motor 28 is resumed. However, though the pump motor 20 commences operation, a recirculation condition may still exist within the first housing section 14 in that the axial movement of the stem 106 and lower sleeve 10 toward the chamber plate 44 may still not be sufficient to cause the central flange portion 122 of the lower sleeve 110 to seal against the valve seat 146. A continued reduction in the fluid pressure within the third and fourth outlet regions 92, 132 facilitates the continued axial movement of the stem 106 and lower sleeve 110 toward the chamber plate 44, eventually resulting in the closure of the fluid passage 56 by the abutment of the central flange portion 122 against the valve seat 146. Once the fluid passage 56 is blocked, the pump 10 resumes its normal (i.e., non-recirculating) operation. As the stem 106 moves axially through the central bore of the support member 102 toward the end cap 18 or alternatively toward the chamber plate 44, the fluid-tight seal between the stem 106 and the support member 102 is maintained by the O-ring 108 as it slides along the inner surface of the central bore of the support member 102.

As previously explained, the lower sleeve 110 is normally attached to the first end portion of the stem 106 in a manner wherein the first flange portion 114 including the notch 116 disposed therein is disposed furthest from the upper sleeve 124. In the unloader valve 100, the lower sleeve 110 is alternatively attachable to the first end portion of the stem 106 in an inverted orientation such that the second flange portion 118 is disposed furthest from the upper sleeve 124. When the amount of axial movement of the stem 106 and lower sleeve 110 toward the end cap 18 is sufficient to create a fluid recirculation condition, but not deactivate the pump motor 28, the majority of fluid will pass into the fluid passage 56 via the notch 116 disposed in the first flange portion 114 or the notch 120 disposed in the second flange portion 118. As such, the recirculation of fluid within the first housing section 14 may be controlled based on the manner in which the lower sleeve 110 is attached to the first end portion of the stem 106. In this respect, if the first flange portion 114 is disposed furthest from the upper sleeve 124, the recirculation rate will be increased due to the notch 116 disposed therein exceeding the size of the notch 120 disposed in the second flange portion 118. Accordingly, the recirculation rate may be decreased by attaching the upper sleeve 110 to the first end portion of the stem 106 such that the second flange portion 118 is disposed furthest from the upper sleeve 124.

Additionally, the fluid pressure level at which the recirculation condition will be initiated can be controlled by the selection of the biasing spring 136. In this respect, the greater the amount of biasing force exerted by the biasing spring 136, the greater the amount of fluid pressure that will need to be built-up in the third and fourth outlet regions 92, 132 to facilitate the axial movement of the upper sleeve 124, stem 106 and lower sleeve 110 toward the end cap 18. Thus, the operational characteristics of the unloader valve 100 may be modified according to the manner in which the lower sleeve 110 is attached to the stem 106, and the sizing of the biasing spring 136.

MOTOR SPEED CONTROL VALVE STRUCTURE AND OPERATION

Referring now to FIG. 5, as an alternative to being provided with the unloader valve 100, the pump 10 may have inserted into the pump housing 12 a modular pump component comprising a motor speed control valve 200. As will hereinafter be described, the motor speed control valve 200 is adapted to decrease the rotational speed of the drive shaft 30 proportionally to increases in the fluid pressure in the outlet chamber, and increase the rotational speed of the drive shaft 30 proportionally to decreases in the fluid pressure in the outlet chamber.

The motor speed control valve 200 comprises a tubular valve plug 202 which defines a closed distal end 204. Inserted into the hollow,interior of the valve plug 202 is an elongate stem 206 which defines a first end 208 and a second end 210. Attached to the second end 210 is an upper sleeve 212 which is configured identically to the upper sleeve 24 previously described in relation to the unloader valve 100, and includes a flag portion 214 extending laterally therefrom. The upper sleeve 212 is slidably received into an outer jacket 216 which is configured identically to the outer jacket 128 previously described in relation to the unloader valve 100, and includes an elongate slot extending longitudinally in the side wall thereof through which the flag portion 214 of the upper sleeve 212 passes. Disposed between the outer jacket 216, upper sleeve 212 and a retaining ring 213 of the motor speed control valve 200 is a diaphragm 218, the peripheral edge of which is compressed between the outer jacket 128 and retaining ring 213. Though not shown, the outer jacket 216 further defines a cup-shaped end portion which is configured identically to the previously described end portion 134 of the outer jacket 128. Disposed within the end portion of the outer jacket 216 is a biasing spring 220 which extends axially through the cylindrically configured interior chamber 215 of the upper sleeve 212 into abutting contact with the innermost surface thereof.

The insertion of the motor speed control valve 200 into the pump housing 12 is facilitated by initially removing the end cap 18 from the first housing section 14. In the event the unloader valve 100 has previously been inserted into the first housing section 14, the same is removed from therewithin by rotating the outer jacket 128 in a manner releasing the previously described bayonet connection. The placement of the motor speed control valve 200 into the first housing section 14 is then accomplished by initially inserting the valve plug 202 into the central opening of the spacer member 72. Importantly, the valve plug 202 is extended into the central opening of the spacer member 72 to a point whereat the distal end 204 thereof completely blocks the fluid passage 56 of the chamber plate 44. The extension of the valve plug 202 into the fluid passage 56 is limited by the abutment of a rounded shoulder 222 defined by the valve plug 202 against a corresponding annular seat defined within the fluid passage 56. Disposed in a circumferential grooved formed in the outer surface of the distal portion of the valve plug 202 is an O-ring 224 which forms a fluid-tight seal between the valve plug 202 and the chamber plate 44.

When the valve plug 202 is fully inserted into the fluid passage 56, the rotation of the outer jacket 216 causes a pair of flange portions 226 formed on the outer surface thereof to properly seat within corresponding recesses formed within the first housing section 14. The flange portions 226 in combination with the recesses define a bayonet connection which allows the motor speed control valve 200 to be rapidly inserted into and removed from within the housing 12. When the motor speed control valve 200 is inserted into and connected to the first housing section 14, the biasing spring 220 biases the stem 206 toward the closed distal end of the valve plug 202 such that the first end 208 is in direct, abutting contact therewith. Additionally, the fourth outlet region 132 is defined between the diaphragm 132, retaining ring 213 and valve plug 202. Subsequent to the insertion of the motor speed control valve 200 into the first housing section 14 in the aforementioned manner, the end cap 18 is reattached to the first housing section 14 via the bolt 24.

With the motor speed control valve 200 inserted into the housing 12, the activation of the pump motor 28 once again causes fluid introduced into the inlet chamber 86 via the fluid inlet port 82 to be drawn into the first outlet regions 88 via the inlet ports 52 in the previously described manner. Thereafter, the fluid is forced through the outlet ports 54 and first unidirectional valve 70 into the second outlet region 90, and through the fluid ports 74 and second unidirectional valve 76 into the third and fourth outlet regions 92, 132. Despite the inclusion of the fluid ports 78 within the spacer member 72, the fluid in the second outlet region 90 is prevented from flowing into the fluid passage 56 due to the seal created by the O-ring 224, and is prevented from flowing between the valve plug 202 and spacer member 72 due to the seals created by a pair of O-rings 228 disposed in a pair of circumferential grooves formed in the outer surface of the proximal portion of the valve plug 202.

In the event of a down-line blockage preventing fluid flow out of the third and fourth outlet regions 92, 132 via the fluid outlet port 84, the resultant increase in fluid pressure in the third and fourth outlet regions 92, 132 acts on the diaphragm 218 by applying pressure thereto in a direction toward the end cap 18. Once the fluid pressure applied to the diaphragm 218 exceeds the biasing force exerted by the biasing spring 220, the stem 206 and upper sleeve 212 move axially toward the end cap 18. Importantly, though the stem 206 moves axially within the interior of the valve plug 202, the valve plug 202 itself remains stationary, thus maintaining the blockage of the fluid passage 56.

Though not shown, the flag portion 214 of the upper sleeve 212 is cooperatively engaged to a speed control unit which is itself electrically interfaced to the pump motor 28. In the motor speed control valve 200, the axial movement of the stem 206 and upper sleeve 212 (and hence the flag portion 214) toward the end cap 18 causes the speed control unit to decrease the rotational speed of the drive shaft 30. Conversely, the axial movement of the stem 206 and upper sleeve 212 toward the chamber plate 44 causes the speed control unit to increase the rotational speed of the drive shaft 30, with the rotational speed of the drive shaft 30 being maximized when the first end 208 of the stem 206 is abutted against the distal end 204 of the valve plug 202 (which occurs when there is no down-line blockage and insufficient fluid pressure in the third and fourth outlet regions 92, 132 to overcome the biasing force exerted by the biasing spring 220).

When the fluid pressure within the third and fourth outlet regions 92, 132 reaches a level sufficient to overcome the biasing force exerted by the biasing spring 220, the resultant axial movement of the stem 206 and upper sleeve 212 toward the end cap 18 will cause the rotational speed of the drive shaft 30 to decrease proportionally to the amount of such axial movement (which is a function of the fluid pressure level within the third and fourth outlet regions 92, 132). If the down-line blockage is removed, the subsequent reduction in the fluid pressure in the third and fourth outlet regions 92, 132 will facilitate the axial movement of the stem 206 and upper sleeve 212 toward the chamber plate 44, thus reducing the rotational speed of the drive shaft 30 in proportion to such axial movement. Once again, the rotational speed of the drive shaft 30 is maximized when the first end 208 of the stem 206 is abutted against the distal end 204 of the valve plug 202, and minimized when the upper sleeve 212 reaches the limit of it axial movement toward the end cap 18.

VALVE PLUG STRUCTURE AND OPERATION

Referring now to FIG. 6, as an alternative to the unloader valve 100 and motor speed control valve 200, the pump 10 may have inserted into the pump housing 12 a third modular pump component comprising a valve plug 300. The valve plug 300 has a hollow, generally conical configuration defining a closed distal end 302 and an open proximal end 304. To facilitate the insertion of the valve plug 300 into the housing 12, the end cap 18 is removed from the first housing section 14, with the unloader valve 100 or motor speed control valve 200 (if previously inserted into the first housing section 14) being removed from therewithin by releasing the bayonet connection in the aforementioned manner. The valve plug 300 is positioned within the first housing section 14 by initially inserting the distal end 302 thereof into the central opening of the spacer member 72. The extension of the valve plug 300 into the central opening is continued until such time as the distal end 302 comes into direct contact with the annular seat defined within the fluid passage 56.

When the valve plug 300 is properly inserted into the housing 12, fluid flowing from the second outlet region 90 into the central opening of the spacer member 72 via the fluid ports 78 is prevented from flowing into the fluid passage 56 due to the seal created by an O-ring 306 disposed in a circumferential groove formed in the outer surface of the distal portion of the valve plug 300. Additionally, fluid is prevented from flowing between the valve plug 300 and spacer member 72 due to the seals created by a pair of O-rings 308 disposed in circumferential grooves formed in the outer surface of the central portion of the valve plug 300. As such, the valve plug 300 serves only to block the fluid passage 56 when disposed within the first housing section 14, and does not create a recirculation condition within the first housing section 14 or adjust the rotational speed of the drive shaft 30, as do the unloader valve 100 and motor speed control valve 200 previously discussed. As further seen in FIG. 6, the end cap 18 attached to the first housing section 14 when the valve plug 300 is inserted thereinto has a substantially smaller profile than the end cap 18 attached to the first housing section 14 when the unloader valve 100 or motor speed control valve 200 is inserted into the first housing section 14.

Advantageously, the operational characteristics of the pump 10 may be quickly, easily and inexpensively modified by simply "changing out" the modular pump components. In this respect, the unloader valve 100, motor speed control valve 200 and valve plug 300 may each be selectively inserted into the housing 12 to obtain a desired type of functionality in the pump 10. Typically, the unloader valve 100 or motor speed control valve 200 will be utilized in the absence of a down-line pressure relief valve. In the event pressure relief devices are, included down-line from the fluid outlet port 84, the pump 10 may be provided with the valve plug 300. Since each of the aforementioned modular pump components is quickly insertable into and removable from within the housing 12, the modification of the operational characteristics of the pump 10 may be accomplished in a quick and easy manner, without the necessity of having to disconnect the fluid inlet and outlet ports 82, 84 from their respective flow lines. Additionally, the ability to modify the operational characteristics of the pump 10 eliminates the cost of having to maintain in stock a multitude of pumps of differing functionality, as well as the need to completely replace a pump from within a flow line when it is desired to modify its operational characteristics.

Additional modifications and improvements of the present invention may also be apparent to those skilled in the art. Thus, the particular combination of parts described and illustrated herein is intended to represent only certain embodiments of the present invention, and is not intended to serve as limitations of alternative devices within the spirit and scope of the invention.

What is claimed is:

1. A positive displacement pump, comprising:

a housing defining a pump inlet port and a pump outlet port;

a chamber plate disposed within the housing and partially defining a pump inlet chamber which fluidly communicates with the inlet port and a pump outlet chamber which fluidly communicates with the outlet port;

a wobble plate disposed within the housing an adapted to pump fluid from the inlet chamber to the outlet chamber; and an unloader valve disposed within and releasably attached to the housing and partially inserted into the chamber plate, said unloader valve being adapted to facilitate the flow of fluid from the outlet chamber to the inlet chamber when the fluid pressure in the outlet chamber exceeds a first pre-determined level, thus causing the fluid to be re-circulated within the housing;

said unloader valve being modularly configured for complete removal from within the housing when detached therefrom, and replacement with an alternative modular pump component to selectively modify the operational characteristics of the pump.

2. The pump of claim 1 further comprising:

a spacer member attached to said chamber plate, said unloader valve being extended through said spacer member;

a first valve attached to said chamber plate; and a second valve attached to said spacer member;

said outlet chamber being partially defined by said chamber plate, said spacer member, and said first and second valves.

3. The pump of claim 1 further comprising a motor attached to said housing and having a rotatable drive shaft extending therefrom, said wobble plate being attached to said drive shaft.

4. The pump of claim 1 wherein said housing comprises:

a first housing section having said chamber plate disposed therein;

a second housing section attached to said first housing section and having said wobble plate disposed therein; and an end cap releasably attached to said first housing section;

said unloader valve being disposed within and releasably attached to the first housing section, and removable from within the first housing section for replacement with the alternative modular pump component by the detachment of the end cap from the first housing section.

5. The pump of claim 4 wherein the unloader valve is releasably attached to said first housing section via a bayonet connection.

6. The pump of claim 3 wherein said unloader valve comprises:

a piston reciprocally movable within said housing between a first position whereat the piston blocks a fluid passage defined by the chamber plate and extending from the outlet chamber to the inlet chamber, and a second position whereat the piston allows fluid to flow from the outlet chamber to the inlet chamber via the fluid passage; and a biasing spring for biasing the piston to the first position;

an increase of the fluid pressure in the outlet chamber above the first pre-determined level being operable to overcome the biasing force exerted by the biasing spring and move the piston from the first position to the second position.

7. The pump of claim 6 wherein the piston comprises:

an elongate stem; and a lower sleeve attached to the stem in a manner wherein said lower sleeve blocks the fluid passage when the piston is in the first position and allows fluid to flow from the outlet chamber to the inlet chamber via the fluid passage when the piston is in the second position.

8. The pump of claim 7 wherein said lower sleeve defines:

a first radially extending flange portion including at least one notch disposed therein;

a second radially extending flange portion including at least one notch disposed therein, the notch disposed in the first flange portion exceeding the size of the notch disposed in the second flange portion; and a central radially extending flange portion formed between the first and second flange portions;

said lower sleeve being attached to said stem such that said first flange portion is disposed within the fluid passage of said chamber plate.

9. The pump of claim 8 wherein said lower sleeve is attached to said stem such that the second flange portion is disposed within the fluid passage of the chamber plate.

10. The pump of claim 7 wherein said unloader valve further comprises a limit switch adapted to be actuated by said piston when the fluid pressure in the outlet chamber exceeds a second pre-determined level, said limit switch being operable to deactivate said motor when actuated by the piston.

11. The pump of claim 10 wherein said piston further comprises an upper sleeve attached to the stem and configured to actuate the limit switch when the fluid pressure in the outlet chamber exceeds the second pre-determined level, said biasing spring being partially inserted into said upper sleeve.

12. The pump of claim 1 wherein said outlet chamber includes a plurality of generally wedge-shaped chamber sections which are successively filled with and purged of fluid during the rotation of said wobble plate.

13. A positive displacement pump, comprising:

a housing defining a pump inlet port and a pump outlet port;

a chamber plate disposed within the housing and partially defining a pump inlet chamber which fluidly communicates with the inlet port and a pump outlet chamber which fluidly communicates with the outlet port;

a wobble plate disposed within the housing and adapted to pump fluid from the inlet chamber to the outlet chamber;

a motor attached to said housing and having a rotatable drive shaft extending therefrom, said wobble plate being attached to said drive shaft; and a motor speed control valve disposed within and releasably attached to said housing and partially inserted into the chamber plate, said motor speed control valve being adapted to decrease the rotational speed of the motor proportionally to increases in the fluid pressure in the outlet chamber, and increase the rotational speed of the motor proportionally to decreases in the fluid pressure in the outlet chamber;

said motor speed control valve being modularly configured for complete removal from within the housing when detached therefrom, and replacement with an alternative modular pump component to selectively modify the operational characteristics of the pump.

14. The pump of claim 13 wherein said motor speed control valve comprises:

a tubular valve plug defining a closed distal end, said valve plug being adapted to block a fluid passage defined by the chamber plate and extending from the outlet chamber to the inlet chamber;

a piston reciprocally movable within said valve plug away from and toward a base position whereat the piston is abutted against the closed distal end of the valve plug;

a biasing spring for biasing the piston to the base position; and a speed control unit cooperatively engaged to the piston in a manner wherein the movement of the piston away from the base position decreases the rotational speed of the motor and the movement of the piston toward the base position increases the rotational speed of the motor, the rotational speed of the motor being maximized when the piston is disposed at the base position;

an increase in the fluid pressure in the outlet chamber beyond the first pre-determined level being operable to overcome the biasing force exerted by the biasing spring and move the piston away from the base position, with a decrease in the fluid pressure in the outlet chamber below the first pre-determined level being operable to move the piston toward and subsequently into the base position.

15. The pump of claim 14 wherein said piston comprises:

an elongate stem; and an upper sleeve attached to said stem which is cooperatively engaged to said speed control unit, said biasing spring being partially inserted into said upper sleeve.

16. The pump of claim 13 wherein said housing comprises:

a first housing section having said chamber plate disposed therein;

a second housing section attached to said first housing section and having said wobble plate disposed therein; and an end cap releasably attached to said first housing section;

said motor speed control valve being disposed within said first housing section, and removable from within the first housing section for replacement with the alternative modular pump component by the detachment of the end cap from the first housing section.

17. The pump of claim 16 wherein the motor speed control valve is releasably attached to the first housing section via a bayonet connection.

18. A positive displacement pump, comprising:

a housing defining a pump inlet port and a pump outlet port;

a chamber plate disposed within the housing and partially defining a pump inlet chamber which fluidly communicates with the inlet port and a pump outlet chamber which fluidly communicates with the outlet port;

a wobble plate disposed within the housing and adapted to pump fluid from the inlet chamber to the outlet chamber; and a valve plug disposed within and releasably attached to said housing and partially inserted into the chamber plate, said valve plug being adapted to block a fluid passage defined by the chamber plate and extending from the outlet chamber to the inlet chamber;

said valve plug being modularly configured for complete removal from within the housing when detached therefrom, and replacement with an alternative modular pump component to selectively modify the operational characteristics of the pump.

19. The pump of claim 18 wherein the housing comprises:

a first housing section having said chamber plate disposed therein;

a second housing section attached to said first housing section and having said wobble plate disposed therein; and an end cap releasably attached to said first housing section;

said valve plug being disposed within said first housing section, and removable from within the first housing section for replacement with the alternative modular pump component by the detachment of the end cap from the first housing section.

20. The pump of claim 19 wherein the valve plug is releasably attached to the first housing section via a bayonet connection.

* * * * *